US006417806B1

(12) United States Patent
Gothard et al.

(10) Patent No.: US 6,417,806 B1
(45) Date of Patent: Jul. 9, 2002

(54) MONOPOLE ANTENNA FOR ARRAY APPLICATIONS

(75) Inventors: Griffin K. Gothard, Satellite Beach; Bing Chiang, Melbourne; Christopher A. Snyder, Palm Bay, all of FL (US)

(73) Assignee: Tantivy Communications, Inc., Melbourne, FL (US)

( * ) Notice: Subject to any disclaimer, the term of this patent is extended or adjusted under 35 U.S.C. 154(b) by 0 days.

(21) Appl. No.: 09/773,251

(22) Filed: Jan. 31, 2001

(51) Int. Cl.[7] ..... H01Q 1/38

(52) U.S. Cl. ..... 343/700 MS; 343/846; 343/702

(58) Field of Search ..... 343/700 MS, 702, 343/846, 848, 829, 845

(56) References Cited

U.S. PATENT DOCUMENTS

| | | | | | |
|---|---|---|---|---|---|
| 4,125,839 | A | | 11/1978 | Kaloi | 343/700 |
| 4,471,493 | A | | 9/1984 | Schober | 455/90 |
| 4,475,111 | A | | 10/1984 | Gittinger et al. | 343/881 |
| 4,608,572 | A | | 8/1986 | Blakney et al. | 343/792.5 |
| 4,827,271 | A | | 5/1989 | Berneking et al. | 343/700 |
| 4,853,704 | A | | 8/1989 | Diaz et al. | 343/767 |
| 5,010,349 | A | | 4/1991 | Mizuno et al. | 343/700 |
| 5,121,127 | A | | 6/1992 | Toriyama | 343/700 |
| 5,210,542 | A | | 5/1993 | Pett et al. | 343/700 |
| 5,216,430 | A | | 6/1993 | Rahm et al. | 343/700 |
| 5,245,349 | A | | 9/1993 | Harada | 343/700 |
| 5,400,040 | A | | 3/1995 | Lane et al. | 343/700 |
| 5,434,575 | A | | 7/1995 | Jelinek et al. | 342/365 |
| 5,442,366 | A | | 8/1995 | Sanford | 343/700 |
| 5,519,408 | A | | 5/1996 | Schnetzer | 343/767 |
| 5,872,542 | A | * | 2/1999 | Simons et al. | 343/700 MS |
| 5,990,836 | A | | 11/1999 | Bhattacharyya | 343/700 |
| 5,995,048 | A | | 11/1999 | Smithgall et al. | 343/700 |
| 6,084,548 | A | * | 7/2000 | Hirabe | 343/700 MS |
| 6,094,177 | A | | 7/2000 | Yamamoto | 343/806 |
| 6,100,855 | A | | 8/2000 | Vinson et al. | 343/846 |
| 6,111,552 | A | | 8/2000 | Gasser | 343/873 |
| 6,114,996 | A | | 9/2000 | Nghiem | 343/700 |
| 6,121,932 | A | | 9/2000 | McCoy et al. | 343/700 |
| 6,140,965 | A | | 10/2000 | Van Hoozen | 343/700 |
| 6,229,486 | B1 | * | 5/2001 | Krile | 343/700 MS |
| 6,255,995 | B1 | * | 7/2001 | Asano et al. | 343/700 MS |
| 6,337,666 | B1 | * | 1/2002 | Bishop | 343/795 |
| 6,346,913 | B1 | * | 2/2002 | Chang et al. | 343/700 MS |

* cited by examiner

*Primary Examiner*—Don Wong
*Assistant Examiner*—Shih-Chao Chen
(74) *Attorney, Agent, or Firm*—Hamilton, Brook, Smith & Reynolds, P.C.

(57) ABSTRACT

A monopole antenna for use with a mobile subscriber unit in a wireless network communications system. The antenna includes a radiating element located near a feed point to minimize transmission delay from the feed point to the element, and a ground patch located above the element to force the beam peak down towards the horizon. The antenna is fabricated with printed circuit board (PCB) photo-etching techniques for precise control of the printed structure. The monopole antenna includes a planar substrate made of dielectric material. A conductive planar element is layered on one side of the substrate, and a conductive planar ground patch is layered on the other side of the substrate. The conductive planar element is located in a lower region of the substrate, while the location of the conductive planar ground patch is offset from the conductive planar element in an upper region of the substrate, that is, the ground patch is stacked above the conductive planar element. The feed point is typically connected to a transmission line for transmitting signals to and receiving signals from the antenna. A strip is connected to the conductive planar ground patch and extends from the patch to a bottom edge of the substrate for coupling the ground patch to a ground plane upon which the antenna is mounted.

19 Claims, 7 Drawing Sheets

MONOPOLE ANTENNA FOR ARRAY APPLICATIONS

BACKGROUND OF THE INVENTION

Code Division Multiple Access (CDMA) communication systems may be used to provide wireless communication between a base station and one or more subscriber units. The base station is typically a computer controlled set of switching transceivers that are interconnected to a land-based public switched telephone network (PSTN). The base station includes an antenna apparatus for sending forward link radio frequency signals to the mobile subscriber units. The base station antenna is also responsible for receiving reverse link radio frequency signals transmitted from each mobile unit. Each mobile subscriber unit also contains an antenna apparatus for the reception of the forward link signals and for transmission of the reverse link signals. A typical mobile subscriber unit is a digital cellular telephone handset or a personal computer coupled to a wireless cellular modem.

The most common type of antenna used to transmit and receive signals at a mobile subscriber unit is an omnidirectional monopole antenna. This type of antenna consists of a single wire or antenna element that is coupled to a transceiver within the subscriber unit. The transceiver receives reverse link signals to be transmitted from circuitry within the subscriber unit and modulates the signals onto the antenna element at a specified frequency assigned to that subscriber unit. Forward link signals received by the antenna element at a specified frequency are demodulated by the transceiver and supplied to processing circuitry within the subscriber unit. In CDMA cellular systems, multiple mobile subscriber units may transmit and receive signals on the same frequency and use coding algorithms to detect signaling information intended for individual subscriber units on a per unit basis.

The transmitted signal sent from a monopole antenna is omnidirectional in nature. That is, the signal is sent with the same signal strength in all directions in a generally horizontal plane. Reception of signals with a monopole antenna element is likewise omnidirectional. A monopole antenna does not differentiate in its ability to detect a signal on one direction versus detection of the same or a different signal coming from another direction.

SUMMARY OF THE INVENTION

Various problems are inherent in prior art antennas used on mobile subscriber units in wireless communications systems. Typically, an antenna array with scanning capabilities consists of a number of antenna elements located on top of a ground plane. For the subscriber unit to satisfy portability requirements, the ground plane must be physically small. For example, in cellular communication applications, the ground plane is typically smaller than the wavelength of the transmitted and received signals. Because of the interaction between the small ground plane and the antenna elements, which are typically monopole elements, the peak strength of the beam formed by the array is elevated above the horizon, for example, by about 30°, even though the beam itself is directed along the horizon. Correspondingly the strength of the beam along the horizon is about 3 db less than the peak strength. Generally, the subscriber units are located at large distances from the base stations such that the angle of incidence between the subscriber unit and the base station is approximately zero. The ground plane would have to be significantly larger than the wavelength of the transmitted/received signals to be able to bring the peak beam down towards the horizon. For example, in an 800 Mhz system, the ground plane would have to be significantly larger than 14 inches in diameter, and in a PCS system operating at about 1900 Mhz, the ground plane would have to be significantly larger than about 6.5 inches in diameter. Ground planes with such large sizes would prohibit using the subscriber unit as a portable device. It is desirable, therefore, to direct the peak strength of the beam along the horizon with antenna elements mounted on a small ground plane so that the subscriber unit is mobile. Further, it is desirable to produce antenna elements with these beam directing features using low-cost mass production techniques.

The present invention greatly reduces problems encountered by the aforementioned prior art antenna systems. The present invention provides an inexpensive monopole antenna for use with a mobile subscriber unit in a wireless same frequency network communications system, such as CDMA cellular communication networks. The antenna includes a radiating element located near a feed point to minimize transmission delay from the feed point to the element, and a ground patch located above the element to to force the beam peak down from about 30° to about 10°. The antenna is fabricated with printed circuit board (PCB) photoetching techniques for precise control of the printed structure.

In one aspect of the invention, the monopole antenna includes a planar substrate made of dielectric material. A conductive planar element is layered on one side of the substrate, and a conductive planar ground patch is layered on the other side of the substrate. The conductive planar element is located in a lower region of the substrate, while the location of the conductive planar ground patch is offset from the conductive planar element in an upper region of the substrate, that is, the ground patch is stacked above the conductive planar element. The conductive planar element includes a feed point which is typically connected to a transmission line for transmitting signals to and receiving signals from the antenna. A strip is connected to the conductive planar ground patch and extends from the patch to a bottom edge of the substrate for coupling the ground patch to a ground plane upon which the antenna is mounted.

In this arrangement, the conductive planar element acts as a monopole element to transmit and receive signals. The ground patch, being positioned above the monopole element, forces the beam transmitted from the antenna to be directed along the horizon.

Embodiments of this aspect can include one or more of the following features. Both the conductive planar element and the conductive planar ground patch are shaped as square to maximize the bandwidth of the antenna. Alternatively, the planar element can have a T-shape with the feed point being located at the bottom of the T-shaped element. Further, the planar element can include downward extensions connected on either side of horizontal portion of the T-shaped element. Or the conductive planar element can include two portions, the first portion being a vertical strip, and the second portion having two arms, each connected to a top end of the first portion and tapering down and away from the vertical strip.

The dielectric material is made from, for example, common PCB materials, such as polystyrene or Teflon. The conductive planar element and the conductive planar ground patch are typically made from copper.

In one embodiment of this invention, the conductive planar element is connected to a phase shifter. The phase shifter is independently adjustable to affect the phase of a respective signal transmitted from the dipole antenna.

Alternatively, the planar element is connected to a delay line. The antenna can be connected to a variable or lumped impedance element and/or a switch. Ideally, the peak strength of the directed beam rises no more than about 10° above the horizon.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1A:
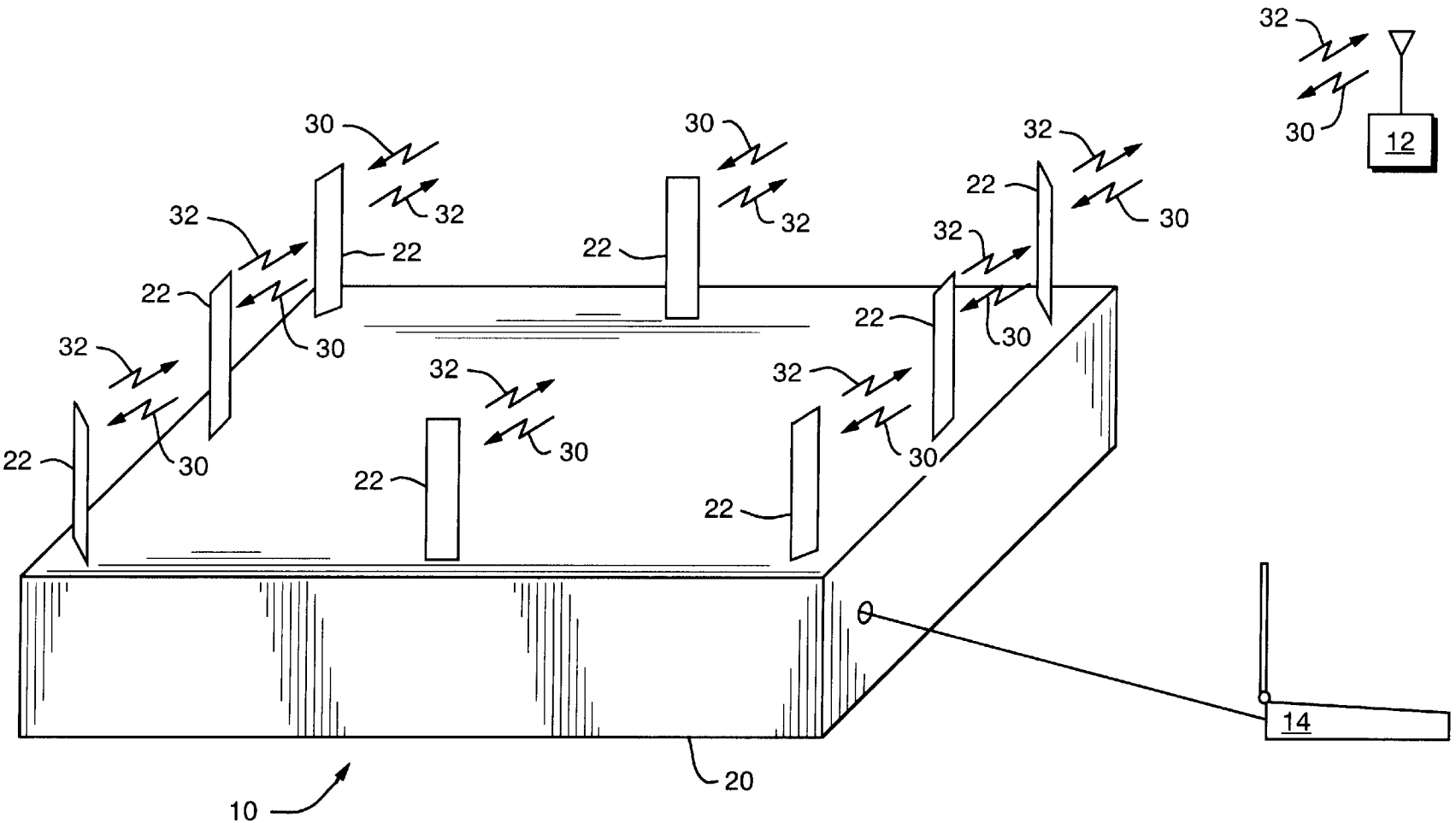
FIG. 1A illustrates a preferred configuration of an antenna apparatus used by a mobile subscriber unit in a cellular system according to this invention.

A description of preferred embodiments of the invention follows. Turning now to the drawings, there is shown in FIG. 1A an antenna apparatus 10 configured according to the present invention. Antenna apparatus 10 serves as the means by which transmission and reception of radio signals is accomplished by a subscriber unit, such as a laptop computer 14 coupled to a wireless cellular modem, with a base station 12. The subscriber unit provides wireless data and/or voice services and can connect devices such as the laptop computer 14, or personal digital assistants (PDAs) or the like through the base station 12 to a network which can be a Public Switched Telephone Network (PSTN), a packet switched computer network, or other data network such as the Internet or a private intranet. The base station 12 may communicate with the network over any number of different efficient communication protocols such as primary ISDN, or even TCP/IP if the network is an Ethernet network such as the Internet. The subscriber unit may be mobile in nature and may travel from one location to another while communicating with base station 12.

It is also to be understood by those skilled in the art that FIG. 1 may be a standard cellular type communication system such as CDMA, TDMA, GSM or other systems in which the radio channels are assigned to carry data and/or voice signals between the base station 12 and the subscriber unit 14. In a preferred embodiment, FIG. 1 is a CDMA-like system, using code division multiplexing principles such as those defined in U.S. Pat. No. 6,151,332.

Antenna apparatus 10 includes a base or ground plane 20 upon which are mounted eight antenna elements 22. As illustrated, the antenna apparatus 10 is coupled to the laptop computer 14 (not drawn to scale). The antenna apparatus 10 allows the laptop computer 14 to perform wireless communications via forward link signals 30 transmitted from the base station 12 and reverse link signals 32 transmitted to the base station 12.

In a preferred embodiment, each antenna element 22 is disposed on the ground plane 20 in the dispersed manner as illustrated in the figure. That is, a preferred embodiment includes four elements which are respectively positioned at locations corresponding to corners of a square, and four additional elements, each being positioned along the sides of the square between respective corner elements.

Figure 2A:
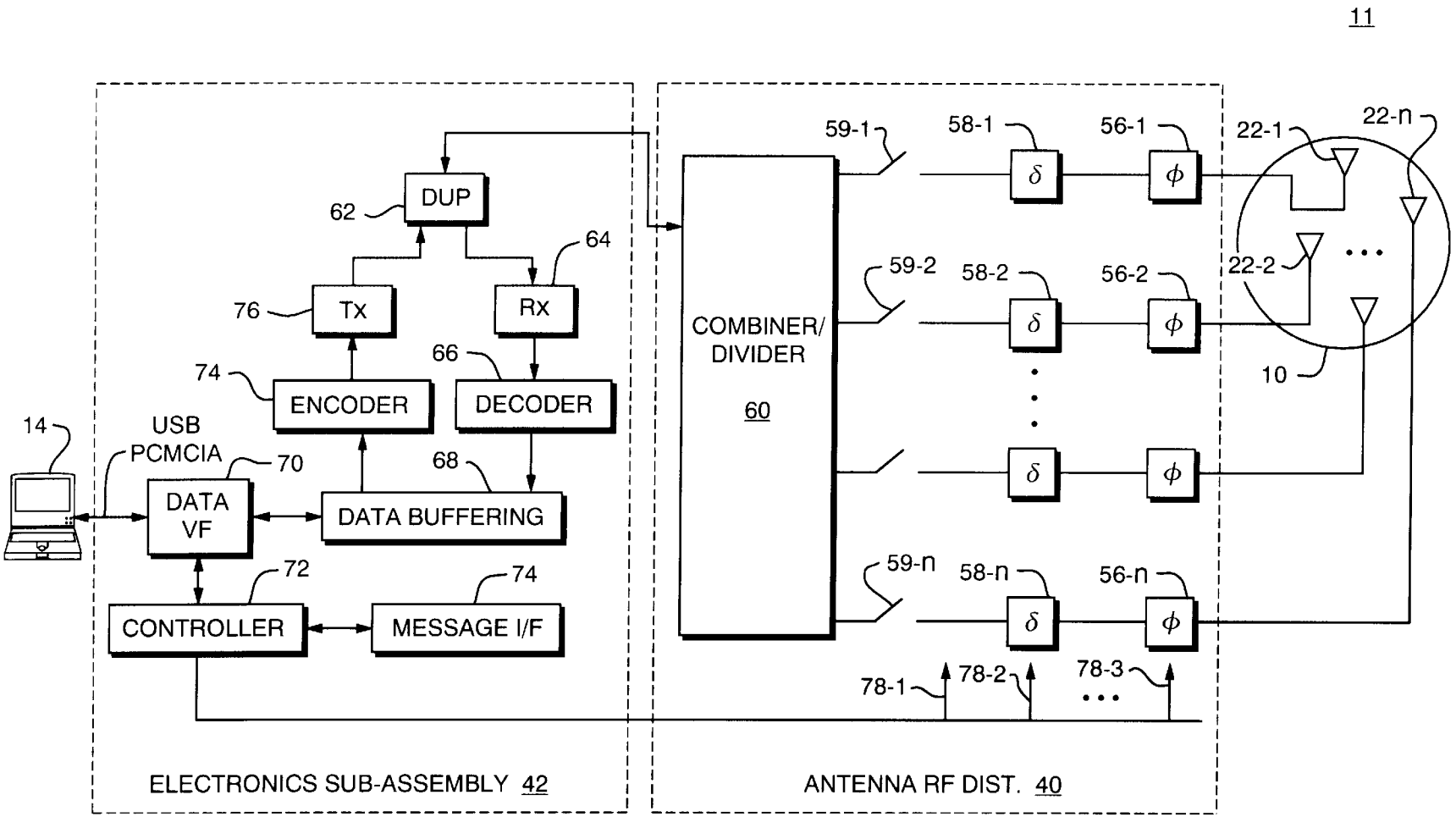
FIG. 2A is a system level diagram for the electronics which control the antenna array of FIG. 1A.

Turning attention to FIG. 2A, there is shown a block diagram of the electronics which control the subscriber access unit 11. The subscriber access unit 11 includes the antenna array 10, antenna Radio Frequency (RF) sub-assembly 40, and an electronics sub-assembly 42. Wireless signals arriving from the base station 12 are first received at the antenna array 10 which consists of the antenna elements 22-1, 22-2, . . . , 22-N. The signals arriving at each antenna element are fed to the RF subassembly 40, including, for example, a phase shifter (or an impedance element) 56, delay 58, and/or switch 59. There is an associated phase shifter 56, delay 58, and/or switch 59 associated with each antenna element 22.

The signals are then fed through a combiner divider network 60 which typically adds the energy in each signal chain providing the summed signal to the electronics sub-assembly 42.

In the transmit direction, radio frequency signals provided by the electronic sub-assembly 42 are fed to the combiner divider network 60. The signals to be transmitted follow through the signal chain, including the switch 59, delay 58, and/or phase shifter 56 to a respective one of the antenna elements 22, and from there are transmitted back towards the base station.

In the receive direction, the electronics sub-assembly 42 receives the radio signal at the duplexer filter 62 which provides the received signals to the receiver 64. The radio receiver 64 provides a demodulated signal to a decoder circuit 66 that removes the modulation coding. For example, such decoder may operate to remove Code Division Multiple Access (CDMA) type encoding which may involve the use of pseudorandom codes and/or Walsh codes to separate the various signals intended for particular subscriber units, in a manner which is known in the art. The decoded signal is then fed to a data buffering circuit 68 which then feeds the decoded signal to a data interface circuit 70. The interface circuit 70 may then provide the data signals to a typical computer interface such as may be provided by a Universal Serial Bus (USB), PCMCIA type interface, serial interface or other well-known computer interface that is compatible with the laptop computer 14. A controller 72 may receive and/or transmit messages from the data interface to and from a message interface circuit 74 to control the operation of the decoder 66, an encoder 74, the tuning of the transmitter 76 and receiver 64. This may also provide the control signals 78 associated with controlling the state of the switches 59, delays 58, and/or phase shifters 56. For example, a first set of control signals 78-3 may control the phase shifter states such that each individual phase shifter 56 imparts a particular desired phase shift to one of the signals received from or transmitted by the respective antenna element 22. This permits the steering of the entire antenna array 10 to a particular desired direction, thereby increasing the overall available data rate that may be accomplished with the equipment. For example, the access unit 11 may receive a control message from the base station commanded to steer its array to a particular direction and/or circuits associated with the receiver 64 and/or decoder 66 may provide signal strength indication to the controller 72. The controller 72 in turn, periodically sets the values for the phase shifter 56.

Figure 1B:
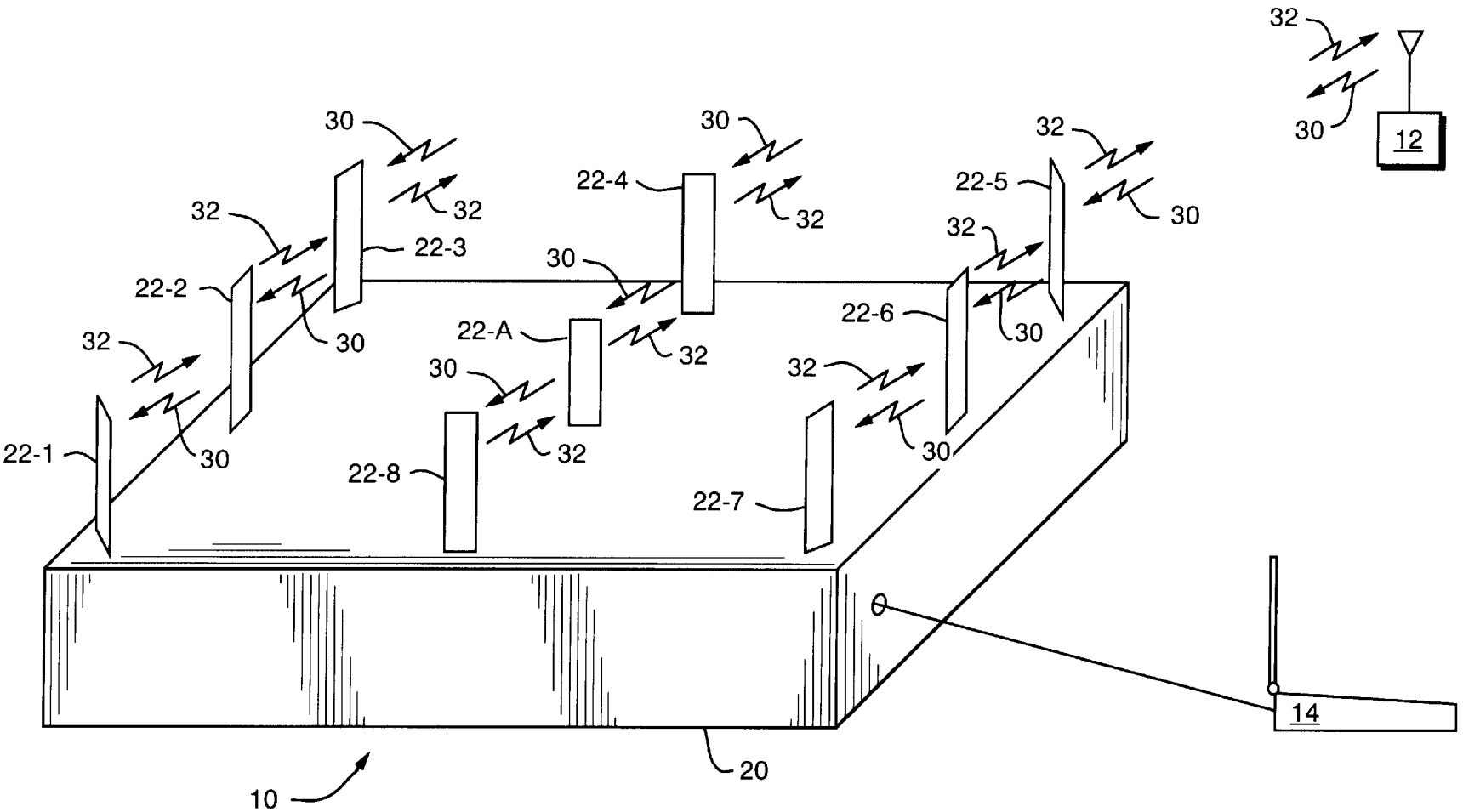
FIG. 1B illustrates another preferred configuration of an antenna apparatus used by a mobile subscriber unit in a cellular system according to this invention.
Figure 2B:
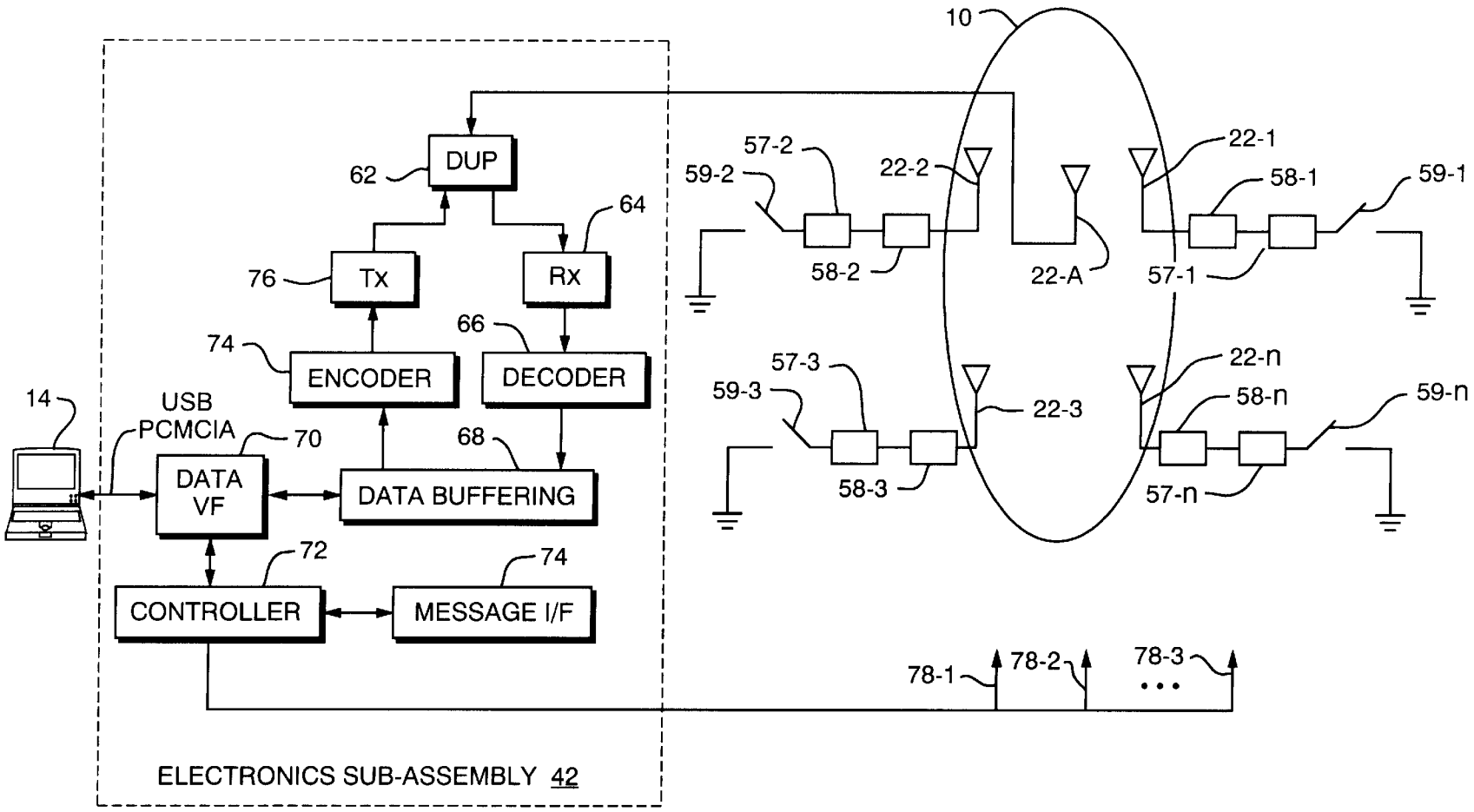
FIG. 2B is a system level diagram for the electronics which control the antenna array of FIG. 1B.

Referring now to FIGS. 1B and 2B, there is shown an alternative arrangement for the antenna array 10 of the access unit 11. In this configuration, a single active antenna element 22-A is positioned in the middle of the ground plane 20 and is surrounded by a set of passive antenna elements 22-1, 22-2, 22-3, . . . , 22-N. (In FIG. 1B, there is shown eight passive antenna elements.) Here only the active antenna element 22-A is connected, directly through the duplexer filter 62, to the electronics sub-assembly 42. An associated delay 58, variable or lumped impedance element 57, and switch 59 is connected to a respective passive antenna element 22-1, 22-2, 22-3, . . . , 22-N.

In the arrangement shown in FIGS. 1B and 2B, the transmit/receive signals are communicated between the base station and the active antenna element 22-A. In turn, the active antenna element 22-A provides the signals to the electronics sub-assembly 42 or receives signals from the assembly 42. The passive antenna elements 22-1, 22-2, 22-3, . . . , 22-N either reflect the signals or direct the signals to the active antenna element 22-A. The controller 72 may provide control signals 78 to control the state of the delays 58, impedance elements 57, and switches 59.

Figure 3B:
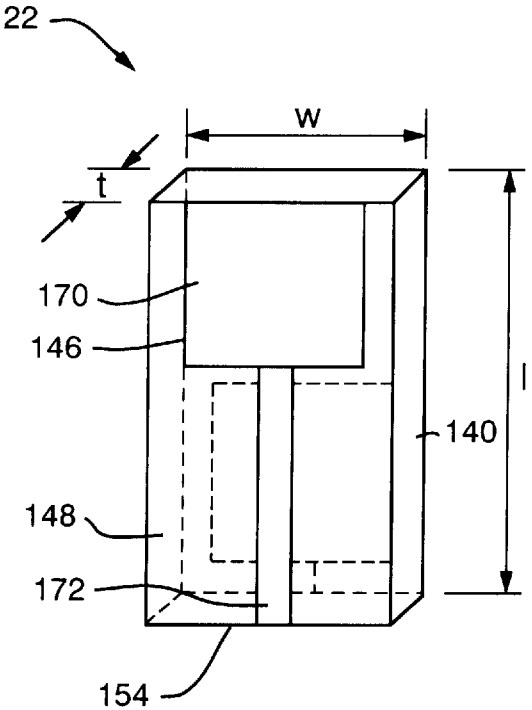
FIG. 3B is a view from the opposite side of the antenna element of FIG. 3A.
Figure 3A:
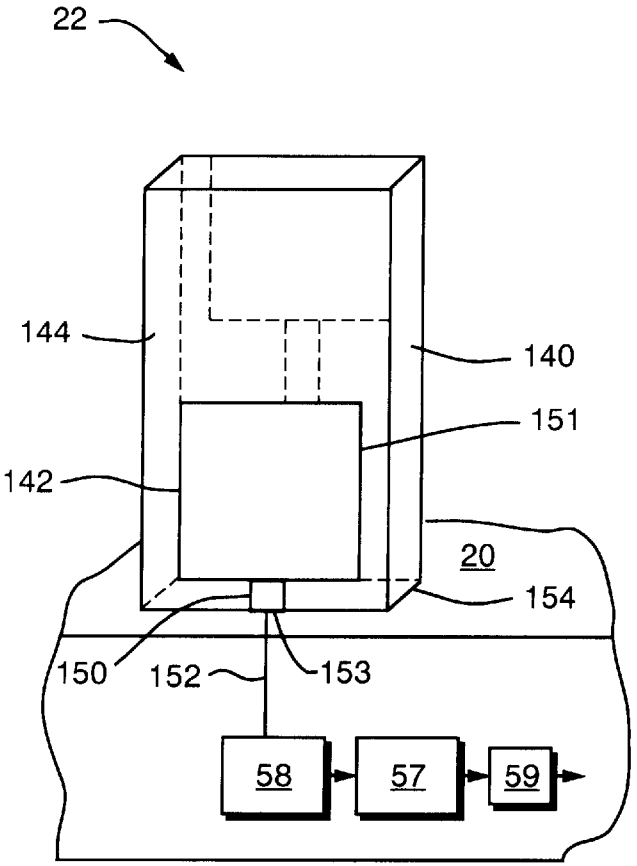
FIG. 3A is a side view of an antenna element of the apparatus of FIG. 1.

As illustrated in FIGS. 3A and 3B, each antenna element 22 includes a substrate 140 upon which a conductive planar element 142 is printed on one side 144 in a lower region of the substrate 140 and a conductive planar ground path 146 is printed on a opposite side 148 in an upper region of the substrate 140. The conductive planar element 142 includes a short feed line 150 which extends from the bottom of an enlarged square-shaped portion 151 of the conductive planar element 142 and connects to a transmission line 152 at a bottom feed point 153 located at a bottom edge 154 of the substrate 140. The conductive planar element 142 and the transmission line 152 are electrically isolated from the ground plane 20. The feed line 150 is shortened to minimized the delay from the feed point 153 to the conductive planar element 142.

When the antenna element 22 acts as a passive element, the transmission line 152 is connected to the delay line 58 which in turn is connected to the variable or lumped impedance element 57 and the switch 59. Specific capacitance values can be intentionally introduced in the feed line to the antenna so that the delay required to change the antenna from a reflective antenna to a directive antenna and vice versa can be tuned to be about one-quarter wavelength apart to maximize the useful passive Referring now in particular to FIG. 3B, the conductive planar ground patch 146 includes an enlarged square portion 170 and is connected to a vertically strip 172 which extends from the bottom of the enlarged square portion 170 to the bottom edge 154 of the substrate 140. The vertically strip 172 couples the conductive planar ground patch 146 to the ground plane 20.

The substrate 140 is made from a dielectric material. For example, the substrate can be made from PCB materials, such as polystyrene or Teflon. For applications in the PCS bandwidth (1850 Mhz to 1990 Mhz), the substrate 140 has a length, "l," of about 2.4 inches, a width "w," of about 0.8 inch, and has a thickness, "t," of about 0.031 inch. The conductive planar element 142, the vertically strip 172, and the conductive planar ground patch 146 are produced with printed circuit board techniques by depositing a respective copper layer to both sides 144 and 148 of the substrate 140 with a thickness of about 0.0015 inch, and then photoetching the copper layer into the desired shapes.

Figure 4:
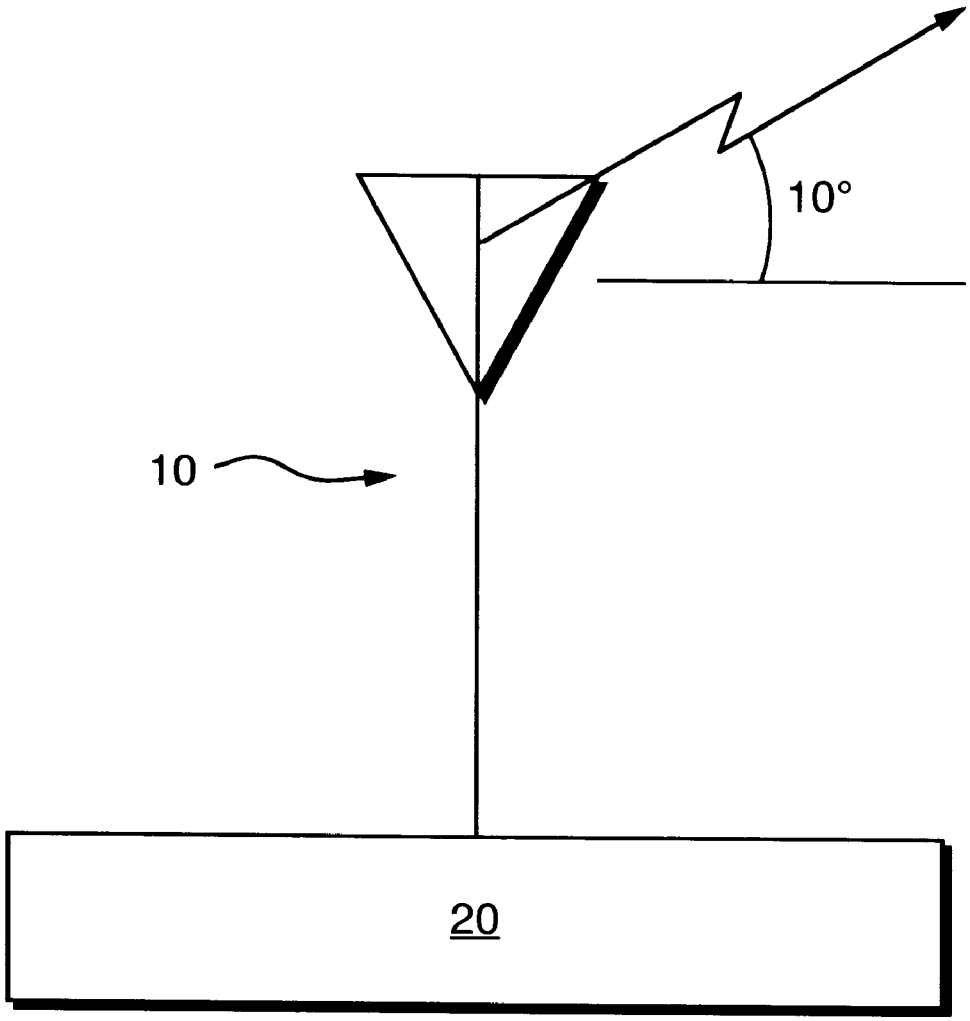
FIG. 4 illustrates a beam directed ten degrees above the horizon by an antenna element configured according to the invention.

In use, the conductive planar element 142 is directly fed by the feed point 153 through the short feed line 150 such that the conductive planar element 142 acts as a monopole antenna. To meet typical bandwidth requirements, the beam formed by the conductive planar element 142 is highly ground-plane dependent. As such, without the presence of the conductive planar ground patch, the peak beam strength of the beam formed by the conductive planar element tilts about 30° above the horizon. However, in most applications the angle of incidence between the base station and the subscriber unit is about 0°. Thus, the conductive planar ground patch 146 is placed above the conductive planar element 142 to force the peak beam down along the horizon. With such a stacked arrangement, the antenna array 10 is capable of transmitting beams with peak beam strengths that rise no more than about 10° above the horizon (FIG. 4).

As mentioned above, the conductive planar element 142 is shaped as a square to maximize the bandwidth of the antenna 22. In PCS applications, the antenna element 22 resonants with a center frequency, "$f_C$," for example, of about 1.92 Ghz with a bandwidth of about 10%. The conductive planar element 142 is square shaped to further maximize the bandwidth of the antenna 22. In alternative embodiments, the conductive planar element 142 can have a non-square shape to enable the antenna element 22 to transmit at other bandwidth requirements such as dual bands or narrow single bands.

Figure 5:
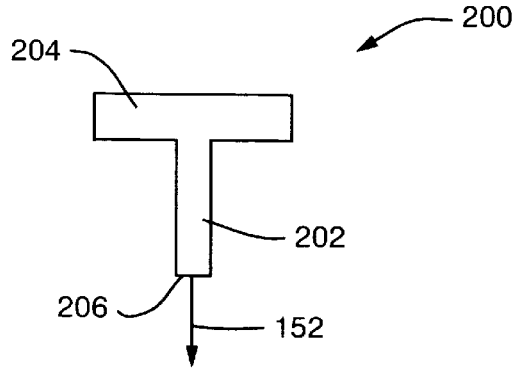
FIG. 5 is an alternative embodiment of an antenna element according to this invention.

For example, referring to FIG. 5, there is shown a T-shaped conductive planar element 200. The element 200 has a vertical strip portion 202 which extends from a midsection of a horizontal strip portion 204. As with the conductive planar element 142 (FIGS. 3A and 3B), the vertical strip portion 202 terminates at a feed point 206 which is connected to a transmission feed line such as the transmission line 152.

Figure 6:
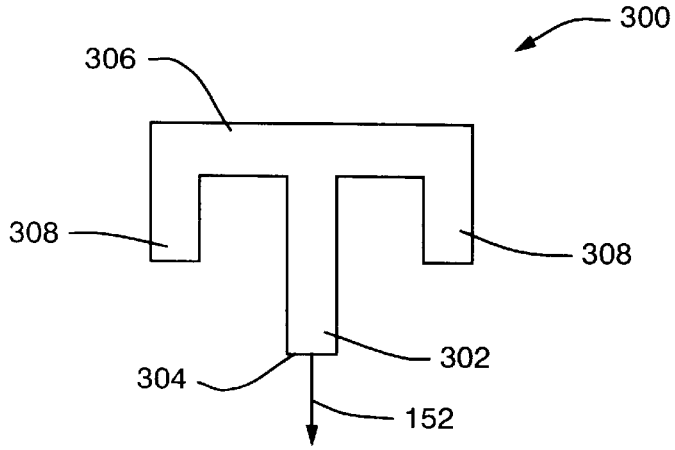
FIG. 6 is another alternative embodiment of an antenna element according to this invention.

In another embodiment shown in FIG. 6, a conductive planar element 300 also has a predominantly T-shaped structure. The conductive planar element 300 includes a vertical strip portion 302 connected to a feed line at a feed point 304 located at the bottom of the planar element 300. The vertical strip portion extends to a horizontal strip portion 306. At either end of the horizontal strip portion 306 is a downward extension 308 that extends towards the bottom of the conductive planar element 300.

Figure 7:
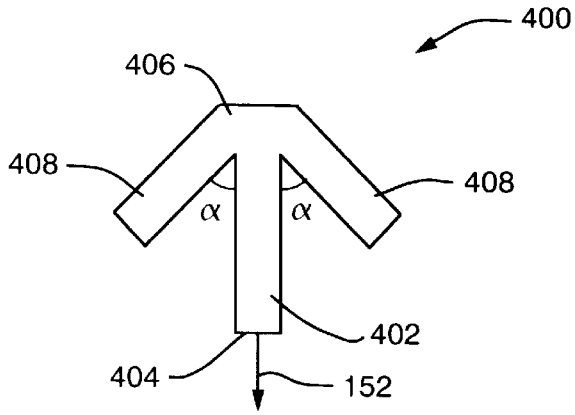
FIG. 7 is yet another alternative embodiment of an antenna element according to this invention.

In yet another embodiment of the invention shown in FIG. 7, a conductive planar element 400 includes a vertical feed strip 402 terminating at a feed point 404 at one end and connected at the other end to the midsection of a second portion 406 of the conductive planar element 400. The second portion 406 of the conductive planar element 400 includes at either end of the second portion 406 a tapered section 408 which tilts downward from a horizontal plane towards the vertical strip 402. Each tapered section 408 and the vertical strip 402 define an angle, "α," of about 45°.

In the embodiments of the invention shown in FIG. 5–7, the length of the horizontal strip portion 204 of the conductive planar element 200, the lengths of horizontal strip portion 306 and the downwards extensions 308 of the conductive planar element 300, and the lengths of the tapered sections 408 of the conductive planar element 400 can be varied. That is, these lengths can be adjusted to so that the conductive planar element resonants with a particular bandwidth.

While this invention has been particularly shown and described with references to preferred embodiments thereof, it will be understood by those skilled in the art that various changes in form and details may be made therein without departing from the scope of the invention encompassed by the appended claims.

What is claimed is:

1. An antenna for use in a wireless communication subscriber unit, comprising a planar substrate made of dielectric material;

a conductive planar element disposed on one side of the substrate and positioned in a lower region of the one side, the conductive planar element including a feed point located at the bottom edge of the substrate; and a conductive planar ground patch disposed on an opposite side of the substrate and positioned in an upper region of the opposite side, and a strip disposed on the opposite side and connected to the conductive planar ground patch, the strip extending from the conductive planar ground patch to the bottom edge of the substrate to facilitate coupling the ground patch to a ground plane positioned substantially orthonormal to the planar substrate;

wherein the conductive planar element acts as a monopole to receive and transmit signals, and the planar ground patch causes the transmitted signals to be directed along a horizon that is substantially parallel to the ground plane.

2. The antenna of claim 1, wherein the conductive planar ground patch is shaped as a square.

3. The antenna of claim 2, wherein the conductive planar element is shaped as a square.

4. The antenna of claim 2, wherein the conductive planar element has a first portion and a second portion disposed at a top end of the first portion such that the conductive planar element is shaped as a T, the feed point being located at a bottom end of the first portion.

5. The antenna of claim 4, wherein the second portion of the conductive planar element includes a first extension and a second extension disposed at a first end and a second end of the second portion, respectively, each extension alinged along a respective axis that is substantially parallel to an axis of the first portion of the conductive planar element.

6. The antenna of claim 2, wherein the conductive planar element includes a first portion and a second portion connected at a top end of the first portion, the second portion having two arms extending from a center of the second portion and flaring away from the first portion of the conductive planar element, the feed point being located at a bottom end of the first portion.

7. The antenna of claim 1, wherein the dielectric material is made from PCB materials.

8. The antenna of claim 1, wherein the dielectric material is made of polystyrene.

9. The antenna of claim 1, wherein the dielectric material is made of Teflon.

10. The antenna of claim 1, wherein the conductive planar element and the conductive planar ground patch are made of copper.

11. The antenna of claim 1, wherein the antenna is connected to a phase shifter, the phase shifter being independently adjustable to affect the phase of the signals transmitted from the antenna.

12. The antenna of claim 1, wherein the conductive planar element is connected to a delay line.

13. The antenna of claim 1, wherein the conductive planar element is connected to a lumped impedance element.

14. The antenna of claim 1, wherein the conductive planar element is connected to a variable impedance element.

15. The antenna of claim 1, wherein the conductive planar element is connected to a switch.

16. The antenna of claim 1, wherein the conductive planar element is connected to a delay line, a lumped impedance element, and a switch.

17. The antenna of claim 1, wherein the conductive planar element is connected to a delay line, a variable impedance element, and a switch.

18. The antenna of claim 1, wherein the feed point of the conductive planar element is connected to a transmission line for transmitting signals to and receiving signals from the antenna.

19. The antenna of claim 1, wherein the directed beam rises above the horizon at an angle of about 10°.

* * * * *